United States Patent [19]

Oroschakoff

[11] 3,959,944

[45] June 1, 1976

[54] MOUNTING AND/OR FIXING MEMBER FOR A REINFORCEMENT OR REINFORCING ELEMENT FOR USE IN REINFORCED CONCRETE STRUCTURES

[76] Inventor: Georgi Oroschakoff, Schutzengasse 27, Vienna III, Austria

[22] Filed: Mar. 27, 1974

[21] Appl. No.: 455,317

Related U.S. Application Data

[63] Continuation of Ser. No. 263,105, June 15, 1972, abandoned.

[30] Foreign Application Priority Data

June 16, 1971 Austria ..... 5221/71
July 8, 1971 Austria ..... 5963/71

[52] U.S. Cl. ..... 52/665
[51] Int. Cl.[2] ..... E04C 5/04; E04C 2/42
[58] Field of Search ..... 52/664, 665, 684, 685, 52/686, 687, 758 B

[56] References Cited

UNITED STATES PATENTS

| | | | |
|---|---|---|---|
| 598,265 | 2/1898 | Lamb | 52/758 B |
| 955,110 | 4/1910 | White | 52/758 B |
| 1,105,789 | 8/1914 | Hough | 52/687 |
| 1,214,790 | 2/1917 | Hough | 52/684 |
| 1,306,129 | 6/1919 | Stewart | 52/686 |
| 1,855,256 | 4/1932 | O'Brien | 52/664 |

FOREIGN PATENTS OR APPLICATIONS

| | | | |
|---|---|---|---|
| 1,134,817 | 8/1962 | Germany | 52/687 |
| 15,877 | 6/1956 | Germany | 52/677 |
| 367,254 | 2/1932 | United Kingdom | 52/685 |

*Primary Examiner*—John E. Murtagh
*Assistant Examiner*—William Randolph
*Attorney, Agent, or Firm*—Karl F. Ross; Herbert Dubno

[57] ABSTRACT

An array of concrete-reinforcement rods is transversely spanned by ladderlike mounting or fixing members. Each member has a pair of parallel long bars extending across the array and pairs of short bars transverse to the long bars and cradling the respective reinforcement rods. The ends of the short bars overhang the long bars and are bent over, across and partly around the reinforcement rod so that corresponding ends of each pair mutually overlap.

3 Claims, 62 Drawing Figures

Fig. 26
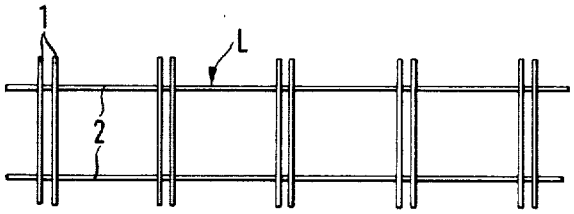
Fig. 28
Fig. 27
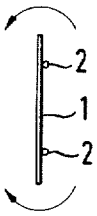
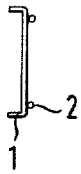
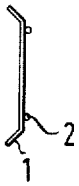
Fig. 29
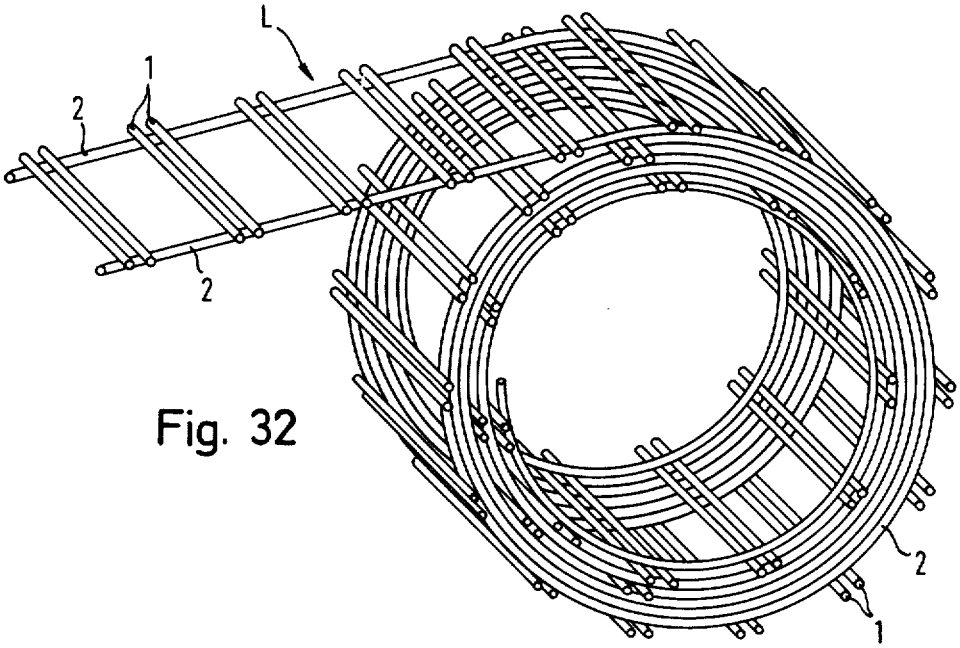
Fig. 32

Fig. 43
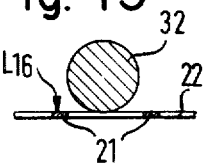
Fig. 44
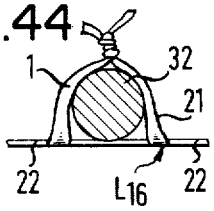
Fig. 45
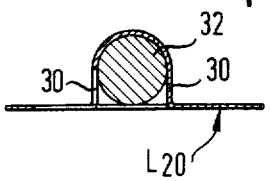
Fig. 46
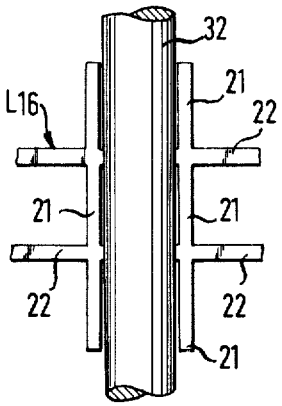
Fig. 47
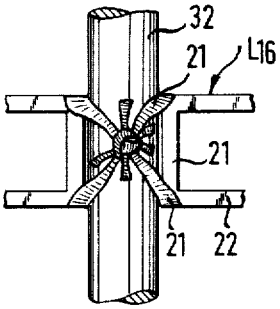
Fig. 48
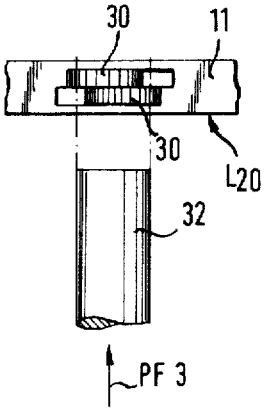
Fig. 49
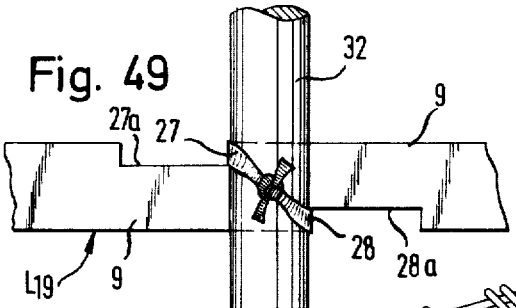
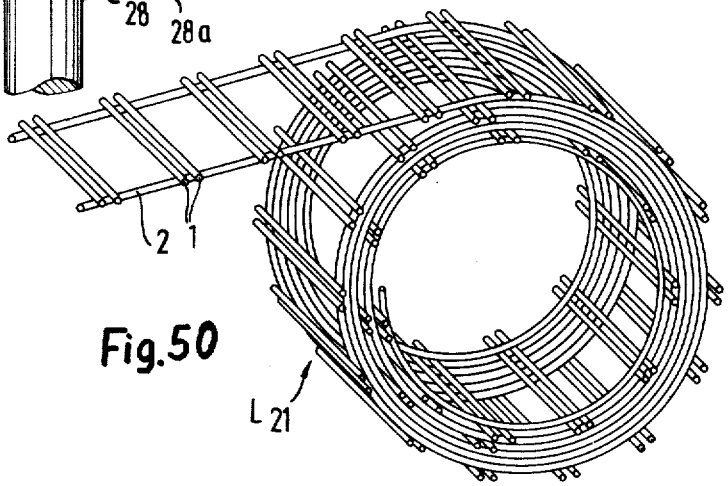
Fig.50

Fig. 51
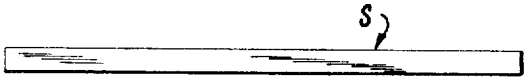
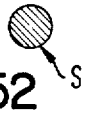
Fig. 52
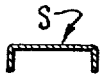
Fig. 53
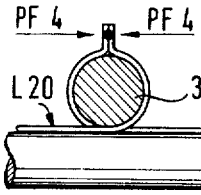
Fig. 55
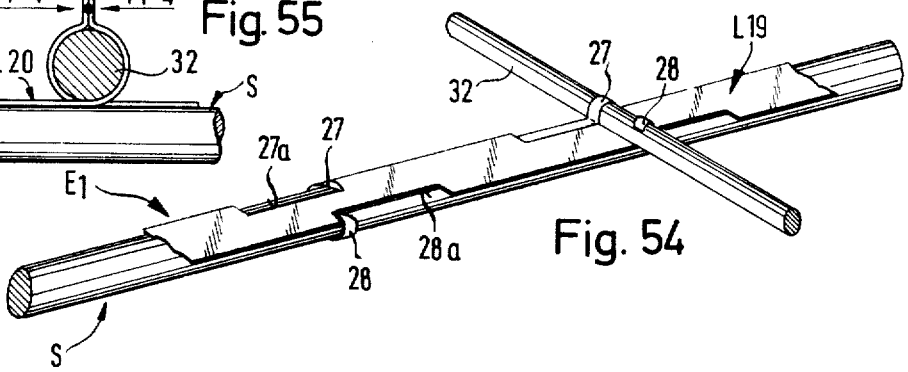
Fig. 54
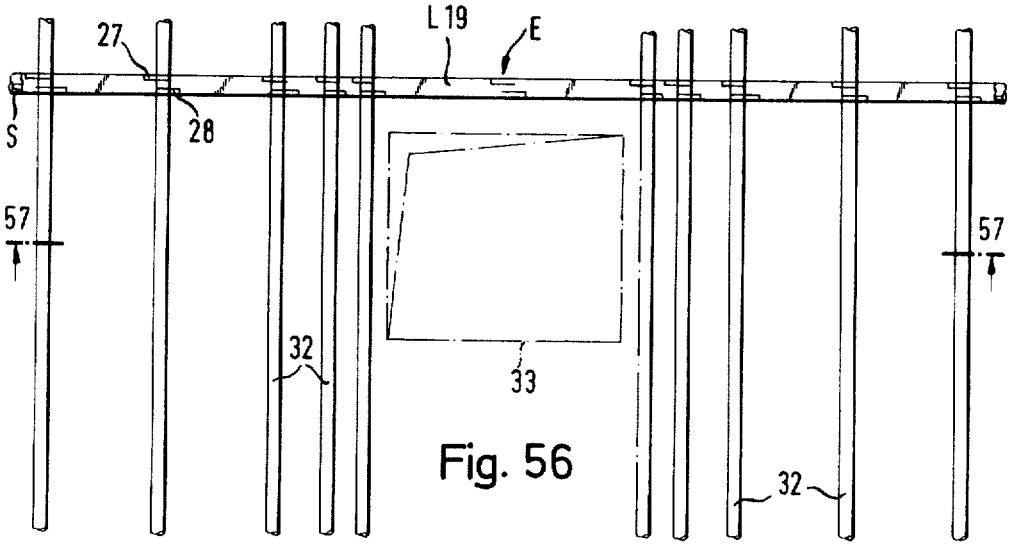
Fig. 56
Fig. 57
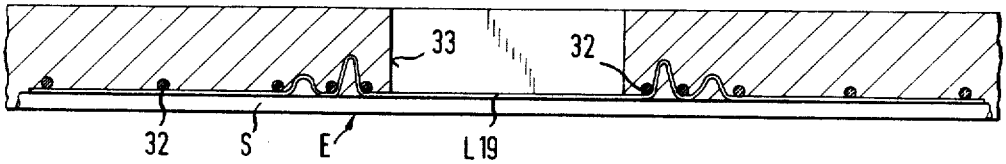

Fig. 58
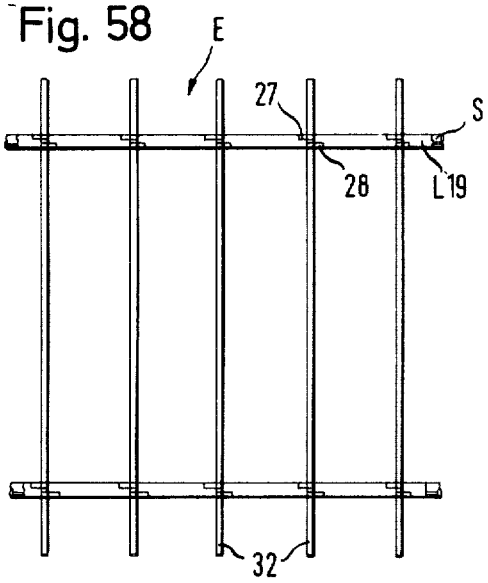
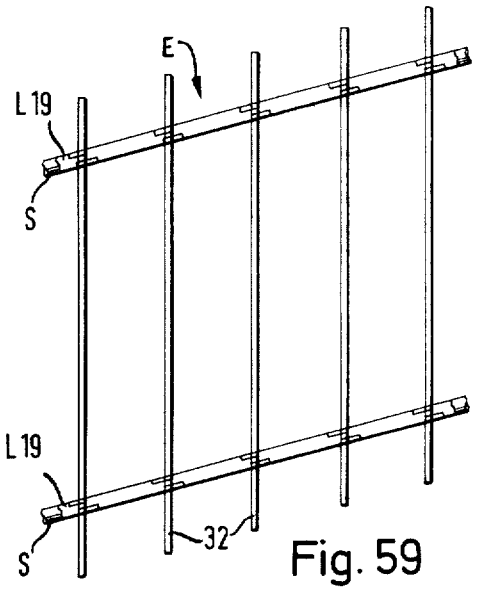
Fig. 59
Fig. 60
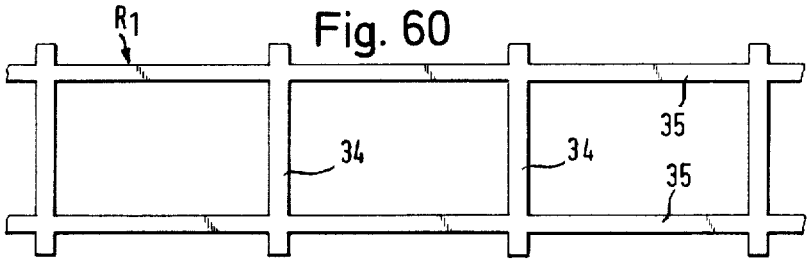
Fig. 61
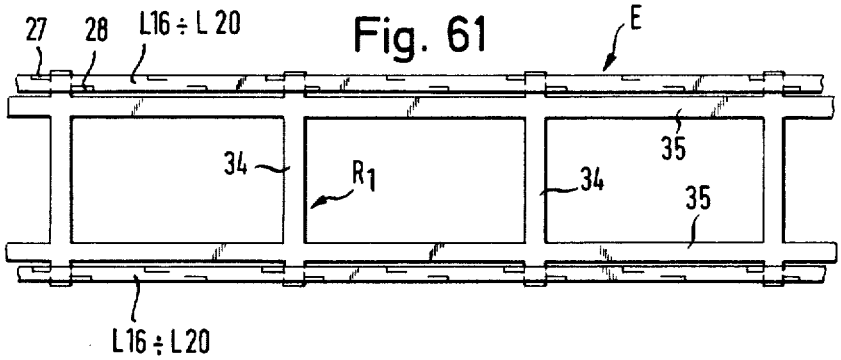
Fig.62
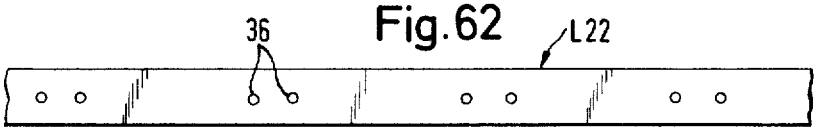

MOUNTING AND/OR FIXING MEMBER FOR A REINFORCEMENT OR REINFORCING ELEMENT FOR USE IN REINFORCED CONCRETE STRUCTURES

This is a continuation of application Ser. No. 263,105, filed June 15, 1972 (now abandoned).

FIELD OF THE INVENTION

This invention relates to a mounting and/or fixing member for a reinforcement or reinforcing element for use in reinforced-concrete structures.

BACKGROUND OF THE INVENTION

In recent years, prefabricated reinforcements or reinforcing elements have been used in concrete on an increasing scale. In most cases, the individual rods of such reinforcing elements have been joined by hand, i.e., the rods were tied with wires, or by machine-welding or by means of plastic couplings or sheet-metal strips. All these known measures enable the prefabrication of reinforcements or reinforcing elements. In welding operations, the additional difficulty arises that welded joints between reinforcing elements are not approved in buildings to be subjected to dynamic stress. For the assembly, it is desired to provide a joint which is rigid at least in one plane to prevent distortion. Such joint could be formed by welding.

OBJECTS OF THE INVENTION

An object of the invention is to establish and maintain the correct distances between the carrying rods of a reinforcing element. It is also desirable to provide reinforcing elements which have any desired width, measured transversely of their carrying rods, and to design the elements in such a manner that they can be assembled although their individual carrying rods have any desired steel cross-section. This is particularly important if these carrying rods extend in two directions, e.g. in a two-way slab. Finally, it is an object of the invention to enable an axial displacement of the carrying rods within the reinforcing element for adaptation to the moment curve.

Finally, it should be possible to provide for a concentration of reinforcing rods along an edge of an opening or recess in the building structure without excessive steel consumption.

SUMMARY OF THE INVENTION

The above-mentioned disadvantages are eliminated and the above objections are fully attained by a mounting and/or fixing member for a reinforcement or reinforcing element, which is provided with guides, which are spaced apart by predetermined, preferably modular, distances and adapted to receive the carrying rods of the reinforcement or reinforcing element. The carrying rods can be detachably held in said guides, if desired. In one embodiment, the mounting and/or fixing member consists of a rigid frame comprising, a pair of transverse rods, which are interconnected and guided by at least two pairs of holders, which extend parallel to and adjacent to the carrying rods. In this case the carrying rods may be connected by tying wire to the guiding holders, although in a preferred arrangement the free ends of the holders are bent over the carrying rods and, if desired, joined thereto, e.g., by welding. According to a further feature of the invention, a guard plate is disposed between each carrying rod and the welded joint connecting the ends of the holders.

DESCRIPTION OF THE DRAWING

Further features and advantages of the invention will become apparent from the following description with reference to the accompanying drawing, in which:

FIGS. 26 and 27 are a top plan view and end view showing a mounting member according to FIGS. 1 and 2 before its deformation;

FIGS. 28 and 29 show two different configurations of the latter mounting member when it has been deformed;

FIG. 32 is a perspective view showing a striplike mounting member which can be coiled;

FIG. 43 is a transverse sectional view showing the mounting member of FIG. 33 and a carrying rod applied thereto before the same has been fixed;

FIG. 44 shows the same arrangement as FIG. 43 with the carrying rod fixed in position;

FIG. 45 is a transverse sectional view showing a carrying rod which is held in position by the mounting member of FIGS. 41 and 42;

FIGS. 46 to 48 are top plan views corresponding to FIGS. 43 to 45, FIG. 48 showing the carrying rod before the same is inserted into the mounting member;

FIG. 49 shows a carrying rod held in position by a fixing member according to FIGS. 39 and 40;

FIG. 50 is a perspective view showing a coiled mounting member;

FIG. 51 shows a strap for fixing a mounting member in position;

FIGS. 52 and 53 are transverse sectional views showing possible configurations of the strap of FIG. 51;

FIG. 54 is a perspective view showing a rod which is provided with a mounting member, which holds a carrying rod of the reinforcement;

FIG. 55 shows a mounting member which has tongues that are joined by welding to hold a carrying rod of the reinforcement in position;

FIG. 56 is a top plan view showing a reinforcement which is disposed adjacent to an opening in the reinforced building structure and has been made with the aid of a mounting arrangement;

FIG. 57 is a sectional view taken on line 57—57 of FIG. 56 through the building structure reinforced according to FIG. 56;

FIG. 58 is a top plan view showing another reinforcement made with the aid of mounting members;

FIG. 59 is a top plan view showing a reinforcement which can be formed by a displacement in the reinforcement shown in the application of a thrust to the reinforcement of FIG. 58;

FIG. 60 shows in plan view a frame for receiving the mounting members so as to prevent a thrust deformation of the reinforcement;

FIG. 61 shows a frame according to FIG. 60 which is provided with mounting members; and FIG. 62 shows an embodiment of the mounting member which is modified from that of FIGS. 33 to 42.

Figure 1:
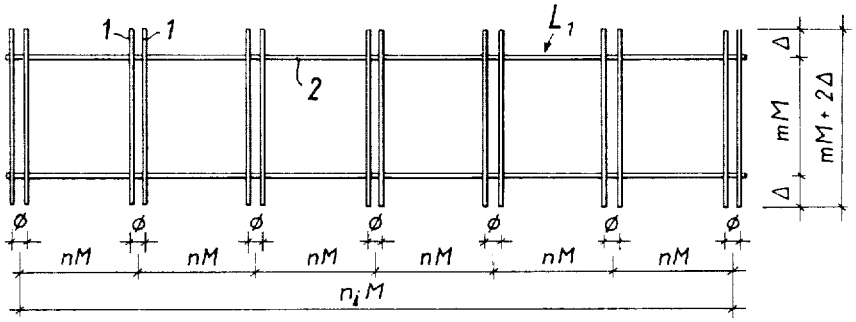
FIG. 1 is a top plan view showing a mounting member according to the invention.

According to FIG. 1 the mounting or fixing member $L_1$ consists of pairs of short parallel holders 1, which are connected by two parallel transverse rods 2, which may be fixed by welding.

Figure 5:
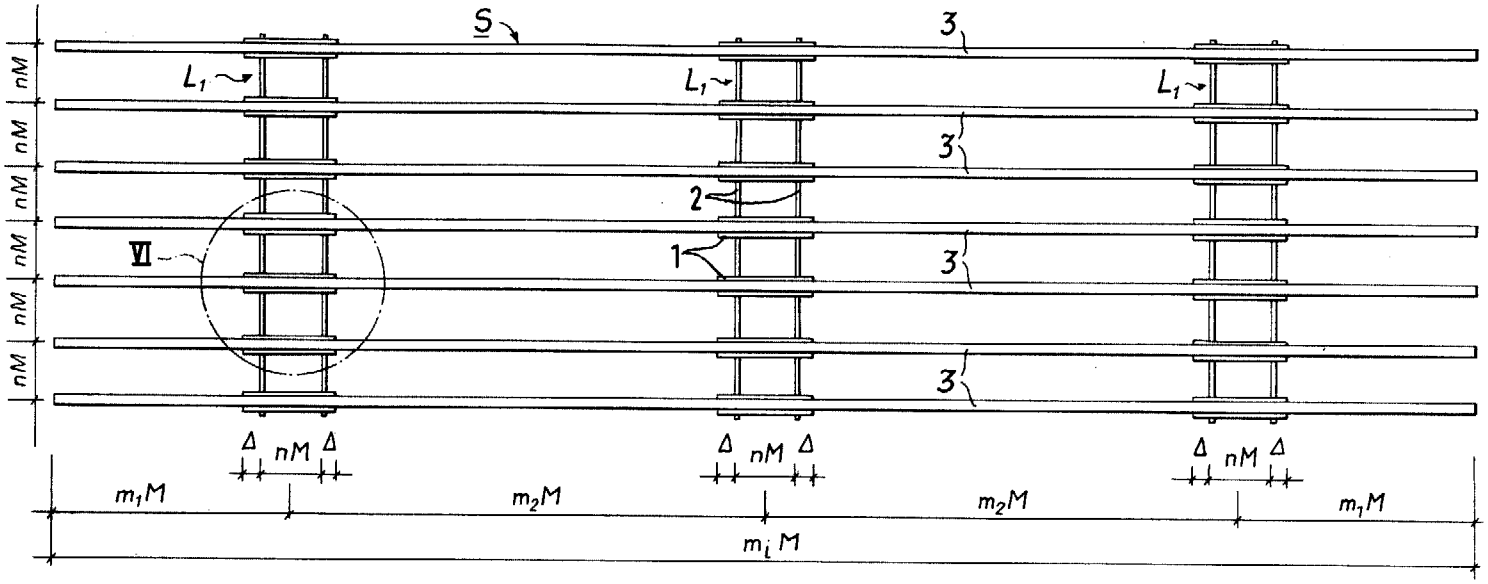
FIG. 5 is a top plan view showing a reinforcement which consists of straight carrying rods and three mounting members according to FIGS. 1 and 2.
Figure 6:
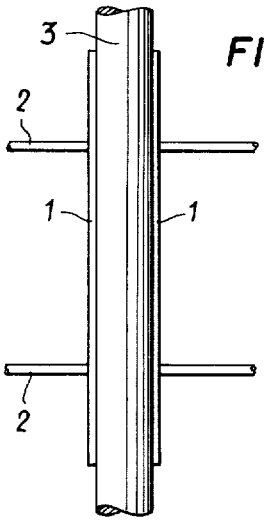
FIGS. 6 and 7 are a top plan view and a side elevational section, respectively, showing the detail in FIG. 5.

The mounting or fixing member $L_1$ thus forms a rigid frame, in which the carrying rods S shown in FIG. 5 can be inserted between the guiding holders (transverse bars or crossbars) 1. This results in a reinforcement or reinforcing element as shown in FIG. 5, the detail VI of which is shown on a larger scale in FIGS. 6 and 7.

It is clearly apparent from the latter figure how the holders (transverse bars or crossbars) 1 guide the carrying or reinforcement rod 3 lying between them on the transverse rod 2.

Figure 7:
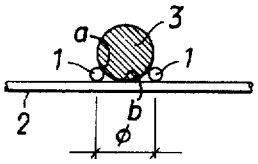

It is apparent from FIGS. 1 and 7 that the spacing of the holders (transverse bars or crossbars) 1 is approximately as large as the diameter $\phi$ of the carrying or reinforcement rod 3. This arrangement results in rigid reinforcing elements having the carrying rods which have not been adversely affected by welding.

Figure 12:
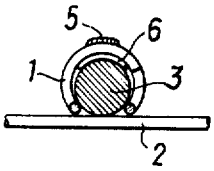
FIGS. 12 and 13 are a side elevational section and an end view showing another embodiment of the joint.
Figure 13:
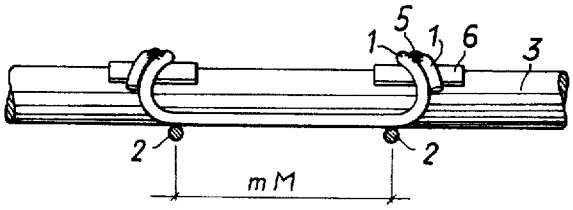
Figure 8:
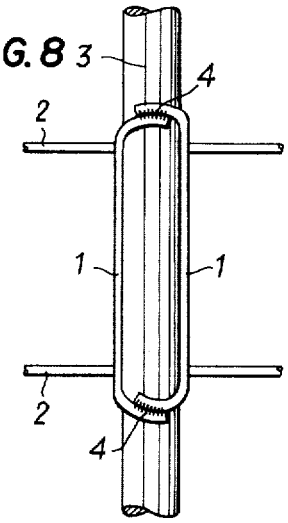
FIGS. 8 and 9 and FIGS. 10 and 11 show two different joints between a carrying rod and a mounting member in a top plan view and a side elevational section similar to FIGS. 6 and 7.
Figure 10:
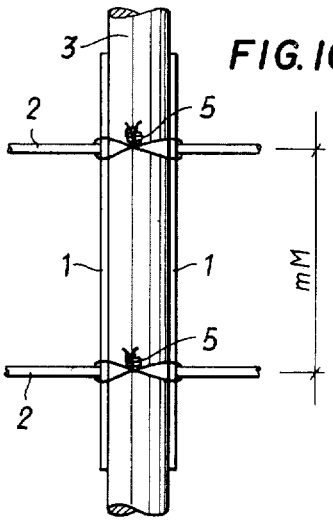
Figure 9:
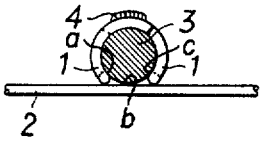
Figure 11:
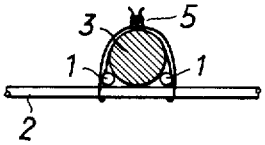
Figure 14:
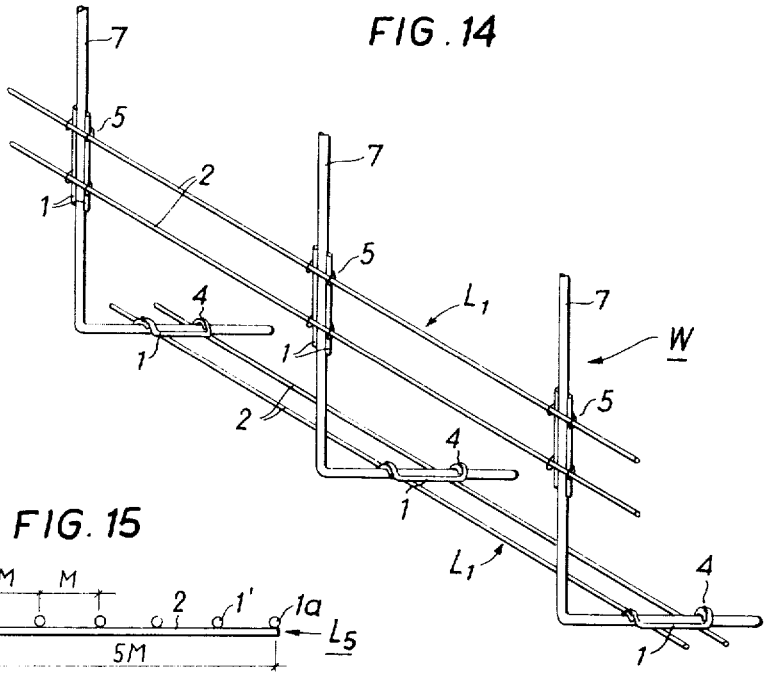
FIG. 14 is a perspective view showing three angle-shaped reinforcing rods, which are connected by two mounting members according to FIGS. 8, 9, and FIGS. 10, 11, respectively.
Figure 15:
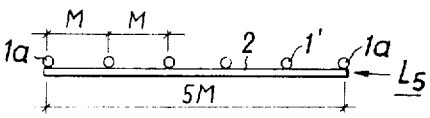
FIGS. 15 to 20 are side elevations showing mounting members which form elements of a modular series and are provided with holders which are regularly spaced or combined in rod groups.
Figure 16:
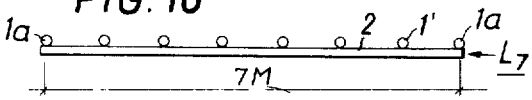
Figure 17:
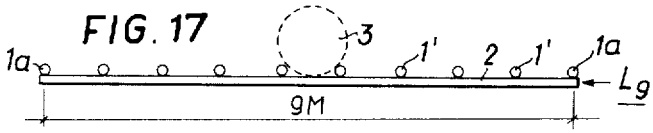
Figure 18:
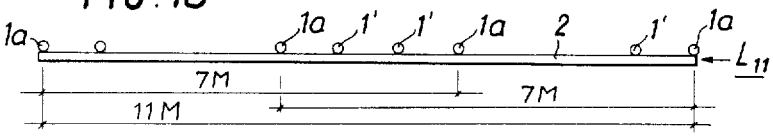
Figure 19:
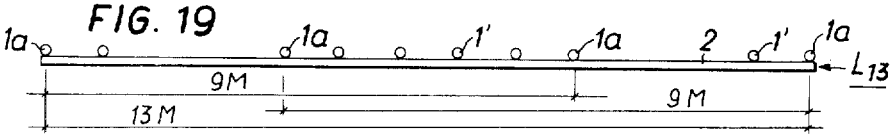
Figure 20:
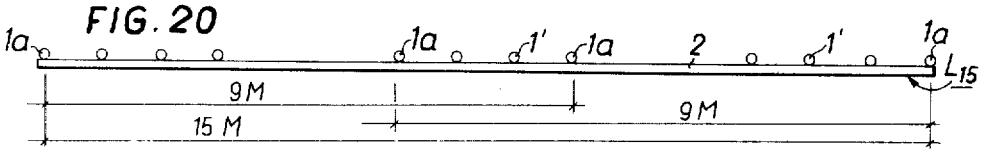

To secure the carrying rods 3, the free ends of the holders (transverse bars or crossbars) 1 are reversely bent about each carrying rod 3 on the side thereof which is opposite the carrying rods (longitudinal bars) 2. FIGS. 8 and 9 show that a welded joint 4 may be used in addition but joins only the surfaces of the holder ends, leaving the underlying carrying rod 3 free. According to FIGS. 10, 11, the carrying rod 3 may be fixed in position by a tying wire 5. FIGS. 12 and 13 show also a welded joint 4; in this case, the carrying rods 3 are protected by a sheet metal strip 6 inserted between the reversely bent holder ends and the carrying rod. It will be understood that the mounting members described thus far reliably guide the carrying rod and also permit of its axial adjustment. When the tying wire 5 shown in FIGS. 10 and 11 has been removed, the carrying rod 3 may be removed from the mounting member as required. Angle-shaped reinforcements may also be made which comprise the carrying rods 7 and the mounting members of FIGS. 1 and 2. This is shown in FIG. 14.

Figure 3:
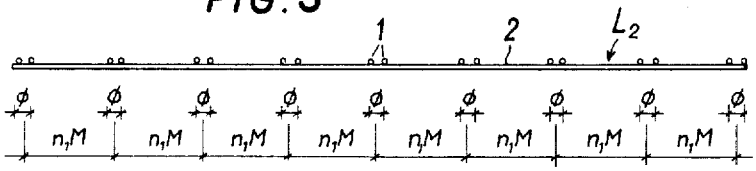
FIGS. 3 and 4 are side elevations respectively showing two modifications of the embodiment of FIGS. 1 and 2.
Figure 4:
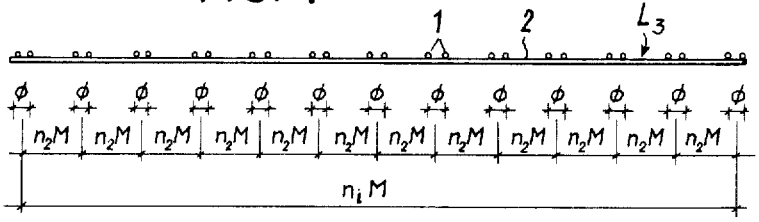

These mounting members are preferably used for reinforcements or reinforcing elements which are elements of a modular system having, e.g., a grid line spacing M. As is apparent from FIG. 1, the holder pair 1 have a spacing $nM$ and the transverse rods 2 have a spacing $mM$, where $n$ and $m$ are integers. The free ends of the holders have a length $\Delta$ and the mounting member $L_1$ has a length $n_t$M. As is apparent from FIGS. 3 and 4, the holder pairs 1 of the mounting members $L_2$, $L_3$ have different spacings $n_1$M, $n_2$M for adaptation to the number of carrying rods 3 which are required. A modular system is also shown in FIG. 5, where the mounting members $L_1$ have a spacing $m_2$M, the free ends of the carrying rods have the length $m_1$M and the carrying rod has the overall length $m_t$M.

It is apparent from FIGS. 15 to 20 that with mounting members $L_5$ to $L_{15}$ having lengths which are graded in a modular system in steps of 2M, beginning with the mounting member $L_5$ having the length 5M to the mounting member $L_{15}$ having the length 15M, the mounting members $L_5$ to $L_9$ are provided with holders 1′ having the same spacing M between the end rods 1*a* whereas in the mounting members $L_{11}$ to $L_{15}$ the rods 1′, 1*a* are combined in rod groups at the edge of the mounting members and in the middle thereof so that equally dimensioned stirrup elements may be used to make beam reinforcements having different widths. In this case, the reversely bent stirrup ends can be hooked through the spaces between the rod groups.

This arrangement permits adaptation to any positioning of the carrying rods, which are inserted between adjacent rods 1′ or 1*a* and 1′. In this case too, a carrying rod 3 is placed between adjacent rods, such as two rods 1′ or a rod 1′ and an adjacent rod 1*a*, serving as holders. This is indicated, e.g., in broken lines in the middle of FIG. 17.

Figure 22:
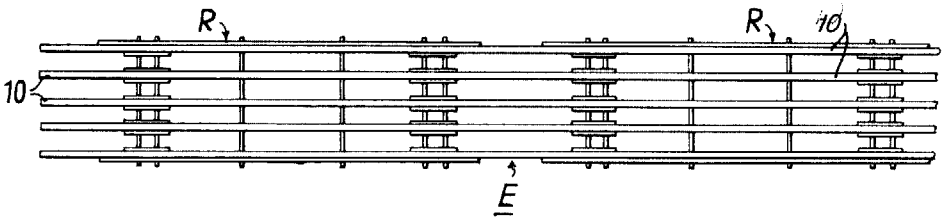
FIG. 22 shows a beam reinforcement consisting of straight carrying rods and two mounting members according to FIG. 21.
Figure 21:
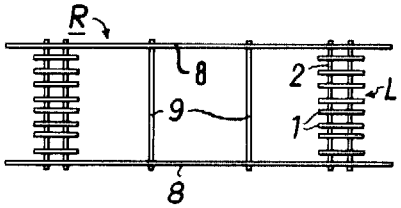
FIG. 21 is a top plan view showing a framelike mounting member.

The mounting member R shown in FIG. 21 consists of two mounting members L, which are held and joined by a rigid frame, which comprises two longitudinal rods 8 and a pair of transverse rods 9. As is apparent from FIG. 22, these mounting members R may be used to advantage to make particularly long reinforcements E, which comprise carrying rods 10.

A mounting member, e.g., the mounting member $L_1$ in FIG. 1, may have transverse rods which are relatively thin and flexible. If these transverse rods 2 are made of wire, the striplike mounting members may be coiled as is indicated in FIG. 32. The length which is required can then easily be cut off.

Figure 23:
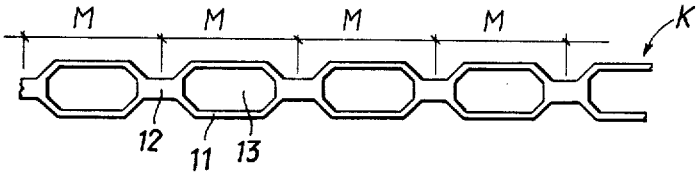
FIG. 23 is a side elevation showing a flexible mounting member.
Figure 24:
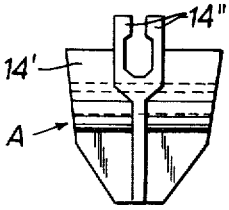
FIG. 24 is a side elevation showing the holder for the carrying rods used therewith.
Figure 25:
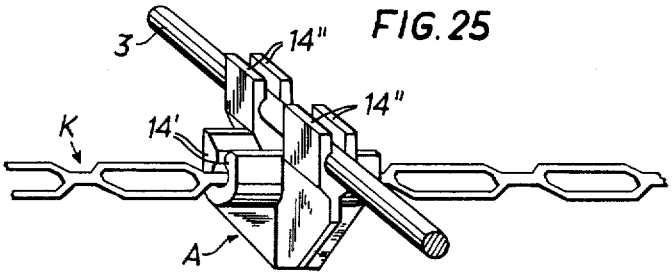
FIG. 25 is a perspective view showing the joint comprising the parts shown in FIGS. 23 and 24 to hold the carrying rod.

Alternatively, a chain K, e.g., of plastics material, is shown in FIG. 23 and consists of chain link portions 11 and connecting webs 12, which have a spacing equal to one grid line spacing M. To form a mounting member in accordance with the invention, a slotted sleevelike member 14' may be used to fit a coupling member A according to FIG. 24 on such chain. The coupling members can hold on its top a carrying rod 3 in position by means of two pairs of gripping jaws 14'' and may be designed like the commercially available spacers. This arrangement has the advantage that the carrying rods 3 can be displaced in the axial and transverse directions because the chain can be twisted so that the coupling member A may be snapped in at any point along the length of the chain.

Figure 2:
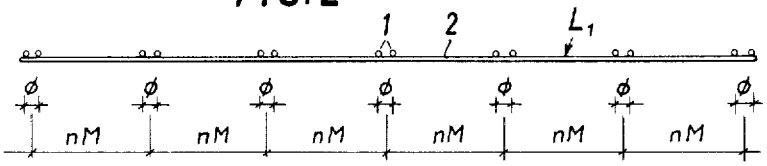
FIG. 2 is a side elevation thereof.

A mounting member L as shown in FIGS. 26 and 27 is made in accordance with FIGS. 1 and 2, and the ends of the holders 1 are subsequently bent in the direction of the arrow in FIG. 27 through 90° in FIG. 28 or through 45° in FIG. 29.

Figure 30:
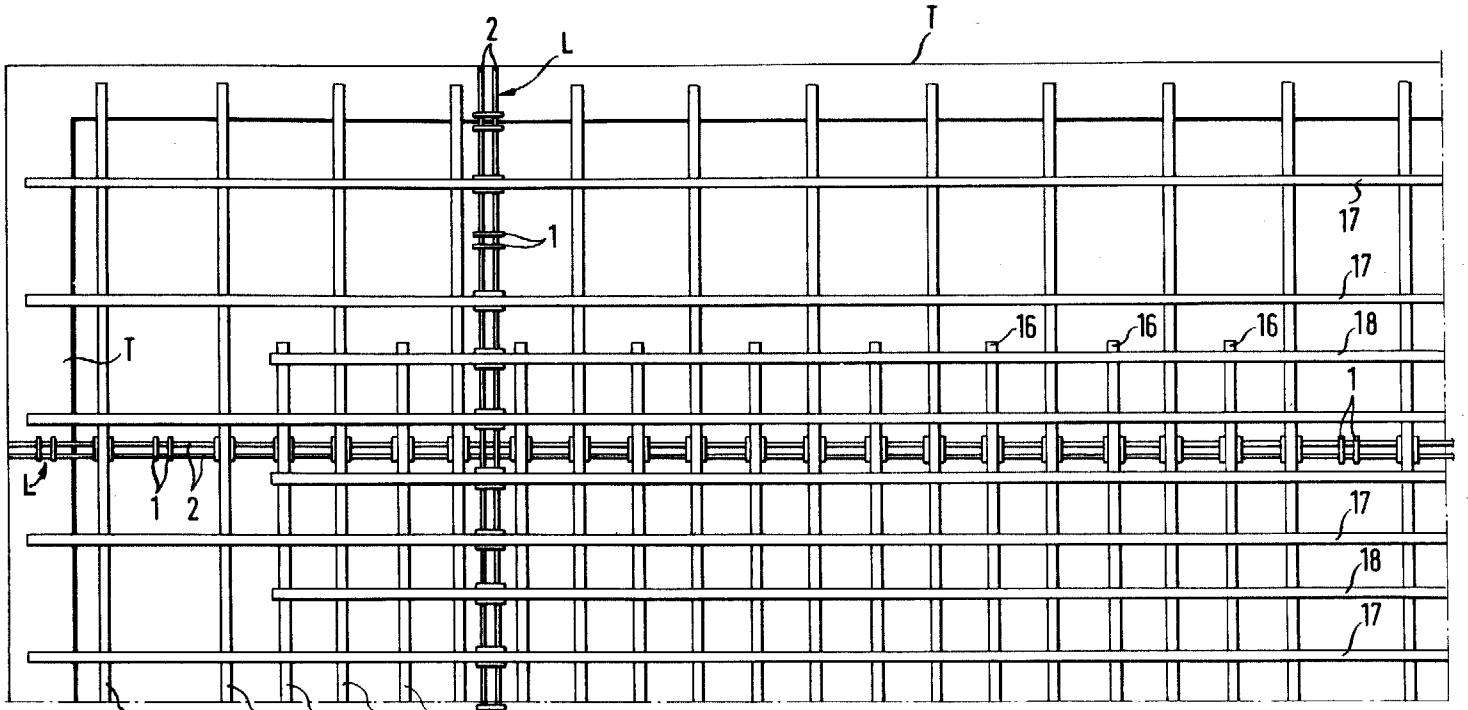
FIG. 30 is a top plan view showing a slab reinforcement comprising two crossing mounting members according to FIG. 28.
Figure 31:
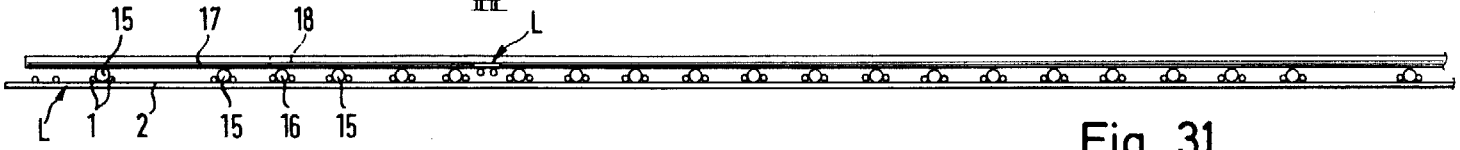
FIG. 31 is the corresponding side elevation.

The resulting mounting member can be used in the reinforcement of a two-way slab, as is apparent from FIGS. 30 and 31. In this case the mounting members L are arranged to cross each other, the free holder ends being on top, and at their ends are secured to the previously applied beam reinforcements T. Sets of rods 15, 16 having different lengths and extending in one direction and similar rods 17, 18 which are transverse to the rods 15, 16 are placed between the bent-up ends of the holders 1 as required. The free ends of the rods 15, 17 are threaded into the beam reinforcements T. The mounting members permit the rods 15, 16 and 17, 18 to be superimposed in direct contact with each other and without need for a spacing between them for the mounting member.

In the mounting members $L_{18}$ to $L_{20}$ shown in FIGS. 33 to 42, the guides are formed by portions of the mounting and/or fixing member itself. According to FIGS. 33, 34, and 37, 38, the guides form ladder rungs 21, 23 and 25 having extensions which laterally protrude from the side 26 or two sides 22 and 24 of the ladder. The ladderlike mounting members shown in FIGS. 33, 34 and 37, 38 may be made in one piece by punching from a strip or by injection molding from plastics material.

In the embodiments shown in FIGS. 39 to 42, guides are provided in that slots 27*a*, 28*a* or 30*a* are formed in the mounting member $L_{19}$, $L_{20}$ having the form of a strip 29 or 31. According to FIGS. 39 and 40, the slots 27*a*, 28*a* are open at the side edges 29*a* of the strip 29 and terminate inside the strip 29. According to FIGS. 41 and 42, the slots are disposed inside the strip throughout their length and extend from a common root defined by the strip 31 whereas at a distance from the root they merge or are connected by another slot. In the mounting members shown in FIGS. 39 to 42, the guide is formed by tongues 27, 28 and 30 resulting from the formation of the slots which are bent out of the plane of the strip 29, 31. The tongues 30 may be bent to assume the configuration shown in FIG. 42.

Figure 33:
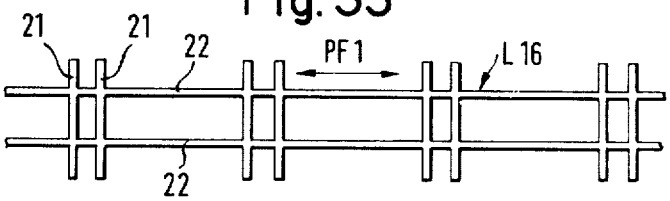
FIGS. 33 and 34 are respectively a top plan view and transverse sectional view showing another embodiment of a mounting member according to the invention.
Figure 34:
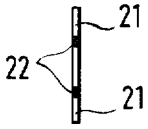
Figure 35:
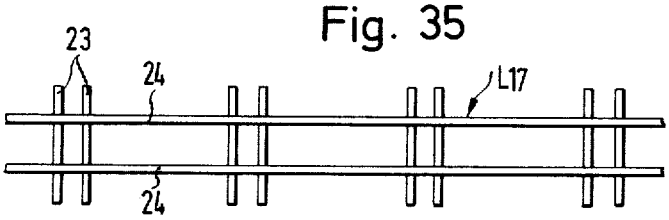
FIGS. 35 and 36 are respectively a top plan view and a transverse sectional view showing another mounting member, which is composed of individual rod elements joined, e.g., by adhering or welding.
Figure 36:
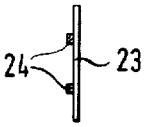
Figure 37:
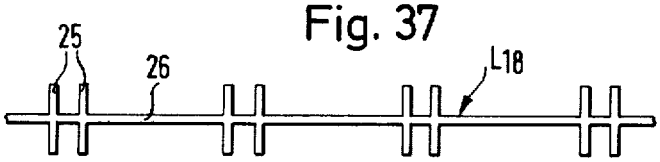
FIGS. 37 and 38 are respectively a top plan view and a transverse sectional view showing a mounting member which is simplified relative to that of FIGS. 33 to 36.
Figure 38:
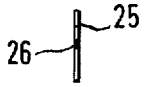

FIGS. 43 and 44 show the formation of the guide for a carrying rod 32 in a mounting member $L_{18}$ shown in FIGS. 33 and 34. To connect the carrying rod 32 to the mounting member, the carrying rod 32 is first placed onto the mounting member $L_{16}$, as is shown in FIG. 43. The free ends of the latter rungs 21 are then bent over the carrying rod and are twisted together as is shown in FIG. 44.

FIG. 46 is a top plan view of the arrangement of FIG. 43 and represents the position of the ladder rungs 21 before they are twisted together. FIG. 47 shows the arrangement when the ladder rungs have been twisted together.

Figure 41:
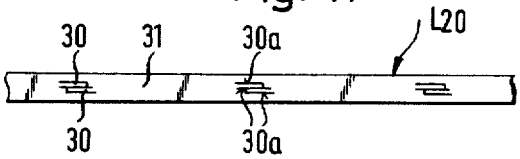
FIG. 41 is a top plan view showing another embodiment of a slotted striplike mounting member.
Figure 42:
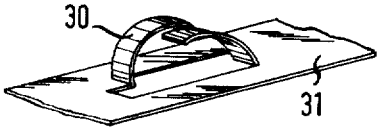
FIG. 42 is a perspective view showing the mounting member of FIG. 41 with bent-up holding tongues for a carrying rod.

FIG. 45 is a transverse sectional view showing the joint between a carrying rod 32 and a mounting member $L_{20}$ shown in FIG. 41, 42. The tongues 30 have been deformed into an eyelike formation. As is apparent from FIG. 48, a carrying rod 32 can be inserted into said eyelike formation in the direction of the arrow PF3.

Figure 39:
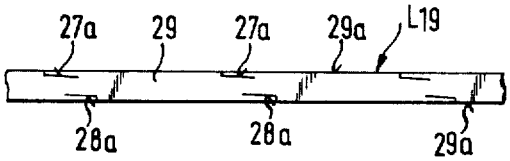
FIG. 39 shows in plan view a mounting member in the form of a slotted strip.
Figure 40:
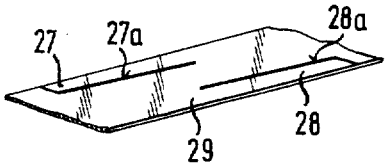
FIG. 40 is a perspective view showing the mounting member of FIG. 39.

FIG. 49 is a top plan view illustrating the use of the mounting member $L_{19}$ shown in FIG. 39 for the fixation of a carrying rod 32. The mounting member $L_{19}$ comprises a strip 29 having two opposite side edges 29*a*, from which respective tongues 27*a*, 28*a* extend, which are bent over the carrying rod 32 whereafter their free ends are twisted together.

FIG. 50 shows how mounting members $L_{21}$ designed, in accordance with FIGS. 33 to 42 and provided with carrying rods 32 may be coiled together with said carrying rods. Any desired length portions of the reinforcement can then be unwound from said coil and cut off.

Mounting members such as are shown in FIGS. 33 to 42 may be used to form a mounting arrangement in that at least one mounting member, e.g., the mounting member $L_{19}$ shown in FIG. 54, is held on a rigid carrying element S e.g., the rod shown in FIG. 51. The rod may have any desired cross-section.

FIGS. 52 and 53 show two of such carrying elements or rods S having different cross-sectional shapes, namely, a circular cross-section and a channel section. As is apparent from FIG. 54, the tongues 27, 28 of the mounting member $L_{19}$ are bent out downwardly, slung around the carrying element S and twisted together to connect the carrying element S to the mounting member $L_{19}$. This assembly comprising the mounting member $L_{19}$ and the carrying element S constitutes a mounting arrangement to which carrying rods 32 can be secured in that those tongues 27, 28 which are not used to hold the carrying element S are slung upwardly over the carrying rod 32 on the side opposite the carrying element S and their free ends are twisted together. The free ends of the tongues can also be joined together by welding when they have been slung around the carrying rod 32. This is shown in FIG. 55 for a mounting member $L_{20}$ according to FIG. 41.

The mounting arrangement $E_1$ shown in FIG. 54 may be designed so that the mounting or fixing element $L_{19}$ is slidably held on the carrying element S. In such an embodiment of a mounting arrangement, different distances between adjacent carrying rods 32 may be provided in that the mounting and/or fixing member is pushed together in the longitudinal direction of its carrying element S. In this case the mounting member must consist of foldable material so that folds like those of a bellows can form in the member as it is pushed together. This is apparent from FIGS. 56 and 57, which show a reinforcement adjacent to an opening 33. It is known that the spacing of the carrying rods 32 must be less adjacent the edges of the openings than in areas remote from the opening.

A rigid mounting arrangement may be made even with the aid of flexible mounting members $L_{16}$ to $L_{20}$ (FIGS. 33 to 42) if the mounting members are held by a rigid, preferably flat frame $R_1$, such as is shown in FIG. 60. The frame $R_1$ consists of rigidly connected transverse rods 34 and longitudinal rods 35. The free ends of the transverse rods protrude preferably over the longitudinal rods 35 so that the protruding ends of the transverse rods 34 form supports for the mounting members $L_{16} - L_{20}$. FIG. 61 is a top plan view showing a frame $R_1$ which is provided with two mounting members according to the invention. The use of such frame $R_1$ prevents a change of a reinforcement from the condition shown in FIG. 58 into a condition shown in FIG. 59.

A mounting member $L_{22}$ shown in FIG. 62 is formed with pairs of holes 36, and a tying wire can be threaded through each pair of holes. The free ends of the tying wire are twisted together to form a guide for a carrying rod.

The embodiments described by way of example may be modified within the scope of the invention. For instance, a mounting member shown in FIGS. 1, 2 may be made entirely or in part of plastic material rather than of metal. It will also be understood that the mounting member need not only receive straight or angle-shaped carrying rods but also U- or C-shaped carrying rods, or closed stirrups having a rectangular or circular configuration, e.g., for making beam basket reinforcements or column reinforcements.

What is claimed is:

1. A concrete-reinforcement assembly comprising:

an array of transversely spaced mutually parallel reinforcing rods; and a plurality of fixing members spaced apart along said reinforcing rods and extending transversely of said rod array, each of said fixing members comprising:

a pair of elongate mutually parallel spaced-apart longitudinal bars of smaller cross-section than that of said rods and extending transversely across said rod array, a plurality of pairs of shorter mutually parallel crossbars connected to said longitudinal bars and extending parallel to said rods of said array, said crossbars being shorter than said rods and of smaller cross-section than that of said rods, the crossbars of each pair having a spacing less than the diameter of a respective rod and cradling same between them, each of said cross bars having both its ends projecting beyond respective ones of said longitudinal bars and bent over, across, partly around and embracing the respective rod and contoured to fit therearound whereby corresponding ends of a pair of crossbars laterally overlap atop the respective rod; and a weld seam joining the overlapped ends of the respective transverse pairs of crossbars at each extremity of the respective pair.

2. The assembly defined in claim 1 wherein said pairs of crossbars of each fixing member are spaced along the longitudinal bars thereof by a distance greater than the distance between the crossbars of each pair.

3. The assembly defined in claim 1 wherein said overlapped ends slidably secure said rods to said members.

* * * * *